US005765406A

United States Patent [19]

Youn

[11] Patent Number: 5,765,406

[45] Date of Patent: Jun. 16, 1998

[54] WASHING MACHINE HAVING AN IMPULSE PULSATOR

[75] Inventor: Kab-Jin Youn, Kwangju, Rep. of Korea

[73] Assignee: Daewoo Electronics Co., Ltd.

[21] Appl. No.: 773,599

[22] Filed: Dec. 27, 1996

[30] Foreign Application Priority Data

Dec. 29, 1995 [KR] Rep. of Korea ..... 95-53375

[51] Int. Cl.[6] ..... D06F 17/10

[52] U.S. Cl. ..... 68/134

[58] Field of Search ..... 68/134, 133, 23.6, 68/131, 132

[56] References Cited

U.S. PATENT DOCUMENTS

| | | | |
|---|---|---|---|
| 3,388,570 | 6/1968 | Cobb et al. | 68/134 |
| 3,805,559 | 4/1974 | Waugh et al. | 68/134 |
| 4,170,882 | 10/1979 | Brenner et al. | 68/134 |
| 4,452,054 | 6/1984 | Hafstrom | 68/134 |
| 4,555,919 | 12/1985 | Brenner et al. | 68/134 |
| 4,856,303 | 8/1989 | Hood, Jr. et al. | 68/134 |
| 4,920,770 | 5/1990 | Dooley vet al. | 68/133 |
| 5,509,283 | 4/1996 | Lee et al. | 68/18 F |
| 5,638,704 | 6/1997 | Kim et al. | 68/133 |
| 5,651,277 | 7/1997 | Richardson | 68/134 |

FOREIGN PATENT DOCUMENTS

| | | | |
|---|---|---|---|
| 53184 | 3/1985 | Japan | 68/134 |
| 1011594 | 1/1989 | Japan | 68/134 |
| 1534122 | 1/1990 | U.S.S.R. | 68/134 |
| 2220681 | 1/1990 | United Kingdom . | |

*Primary Examiner*—Amy B. Vanatta
*Attorney, Agent, or Firm*—Beveridge, DeGrandi, Weilacher & Young LLP

[57] ABSTRACT

A washing machine having an impulse pulsator is disclosed. The washing machine has a pulsator assembly having a first pulsator rotating in the washing tub and the impulse pulsator assembled with the first pulsator. The first pulsator has a supporting bar being extended to the axis direction thereof, and the impulse pulsator has a cylinder part assembled with the supporting bar by insertion. On an outer surface of the cylinder part, many wings are disposed symmetrically to be centered with the axis. The first pulsator and the impulse pulsator are fixed with each other to be capable of relative rotation within a predetermined angular distance. When the motor begins to drive the pulsator assembly, the first pulsator begins to be rotated first, and after the rotation of the first pulsator at the predetermined angular distance, the impulse pulsator begins to be rotated by the first pulsator. Due to the wings of the impulse pulsator, a strong water current is generated in the upper part of the washing tub, so that the washing efficiency is improved. In that situation, the water current in the lower part in the washing tub by the first pulsator and the water current in the upper part in the washing tub by the impulse pulsator are generated at different times from each other. Accordingly, the turbulent force between the water and the laundry is greater, and the washing efficiency is much improved.

2 Claims, 4 Drawing Sheets

WASHING MACHINE HAVING AN IMPULSE PULSATOR

BACKGROUND OF THE INVENTION

1. Field of the Invention

The present invention relates to a washing machine having an impulse pulsator, and more particularly to a washing machine for enhancing the intensity of a water current in a washing tub by an impulse pulsator which is assembled with a pulsator and has a plurality of wings in a radial direction.

2. Prior Art

A general washing machine for washing the laundry is shown in FIG. 1. The washing machine has an out-casing forming the outer shape thereof, a tub 10 suspended in the out-casing 15 by a number of suspension bars (not shown), and a washing tub 20 accommodated in the tub 10. The laundry and the water used in washing operation are accommodated in the washing tub 20. A pulsator 30 is installed on the lower part of the washing tub 20. A motor 40 and a shaft assembly 50 are installed under the tub 10. The shaft assembly 50 is driven by the motor 40 and transmits the torque of the motor 40 to the pulsator 30 or the washing tub 20 according to the operation mode of the washing machine.

The pulsator 30, as shown in FIG. 2, consists of a body 32 having the shape of a disc, and a plurality of stirring wings 36 extended upwardly from the body 32. The stirring wings 36 are formed together with the body 32, and disposed radially and symmetrically to the axis of the body 32. The stirring wings 36 increase the resistance power against the water in the washing tub 20 when the pulsator 30 rotates, thereby generating a strong water current.

When the washing operation is in progress, the torque of the motor 40 is transmitted to the pulsator 30 through the shaft assembly 50, and then the water current rotating in a forward or a reverse rotational direction is generated and the washing operation for the laundry accommodated in the washing tub 20 is carried out. When the dehydration operation is in progress, the torque of the motor 40 is simultaneously transmitted to the washing tub 20 and the pulsator 30 through the shaft assembly 50. At that time, the shaft assembly 50 rotates the washing tub 20 and the pulsator 30 with high rotational velocity in one rotational direction, and then the dehydration operation of the laundry in the washing tub 20 is carried out.

However, in a conventional washing machine, there is a problem that the water current with great power is generated in the lower part of the washing tub 20, but the water current in the upper part of the washing tub 20 is weakened due to the distance from the pulsator 30. As a result, the washing operation is not executed efficiently. That is, the strong water current generated by the pulsator 30 in the lower part of the washing tub 20 becomes weak as it goes to the upside of the washing tub 20 since it stirs up the laundry and water, and the water current is considerably weakened in the vicinity of the upper end area of washing tub 20. Furthermore, since the water current is merely formed to a circular form, the water and the laundry rotate together and the turbulent force between the water and the laundry is so small that the washing effect is not achieved sufficiently.

SUMMARY OF THE INVENTION

The present invention has been proposed to overcome the above described problems in the prior art, and accordingly it is an object of the present invention to provide a washing machine which is possible to generate a strong water current not only in the lower part but also in the upper part of a washing tub, and to generate a complex water current in order to enhance the efficiency of the washing operation thereof.

To achieve the above object, the present invention provides a washing machine comprising: a first pulsator installed rotatably in a washing tub, said first pulsator having a supporting bar extended to an axis direction thereof; a second pulsator assembled to said supporting bar for relatively rotating to said first pulsator, said second pulsator having at least one wing protruded to a radial direction of the axis; a means for fixing said first pulsator with said second pulsator to be capable of relative rotation therebetween within a predetermined angular distance; and a means for driving said first pulsator in a forward and a reverse rotational direction.

It is preferable to dispose said wings with equal angular distance on an outer surface of said second pulsator, and said wings can be made of an elastic material.

Furthermore, by disposing said wings to be inclined against the axis direction, it is possible to generate a more complex water current.

Also, it is more preferable that said second pulsator has a cylinder part assembled with said supporting bar, so as to make it easy to assemble said first pulsator and said second pulsator.

Here, it is still more preferable that said fixing means comprises: a protrusion protruded from an inner surface of said cylinder part, said protrusion being accommodated in a groove formed on a part of an outer surface of said supporting bar along a rotational direction thereof; and at least one projection formed on a portion of said groove for confining further relative rotation of said supporting bar to said second pulsator when said supporting bar rotates at a certain angular distance against said second pulsator.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 3:
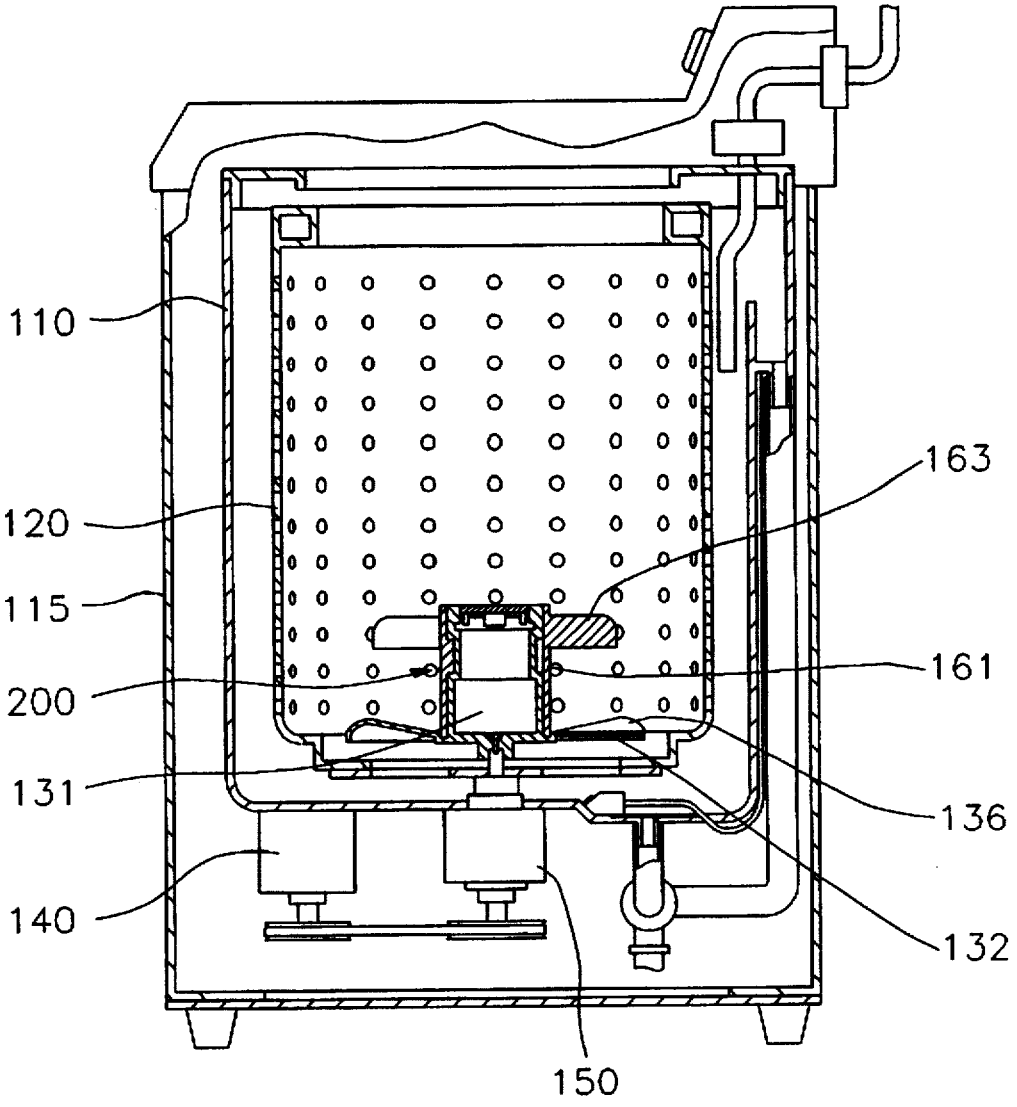
FIG. 3 is a side sectional view of a washing machine according to the present invention.

FIG. 3 is a side sectional view of a washing machine according to the present invention. The washing machine according to the present invention has, as the conventional washing machine shown in FIG. 1, an out-casing 115 forming the outer shape thereof, a tub 110 suspended in the out-casing 115 by a number of suspension bars (not shown), and a washing tub 120 accommodated in the tub 110. The laundry and the water used in washing operation are accommodated in the washing tub 120, and a pulsator assembly 200 according to the present invention is installed on the lower part of the washing tub 120. A motor 140 and a shaft assembly 150 are installed under the tub 110. The shaft assembly 150 is driven by the motor 140 and transmits the torque of the motor 140 to the pulsator assembly 200 or the washing tub 120 according to the operation mode of the washing machine.

Figure 1:
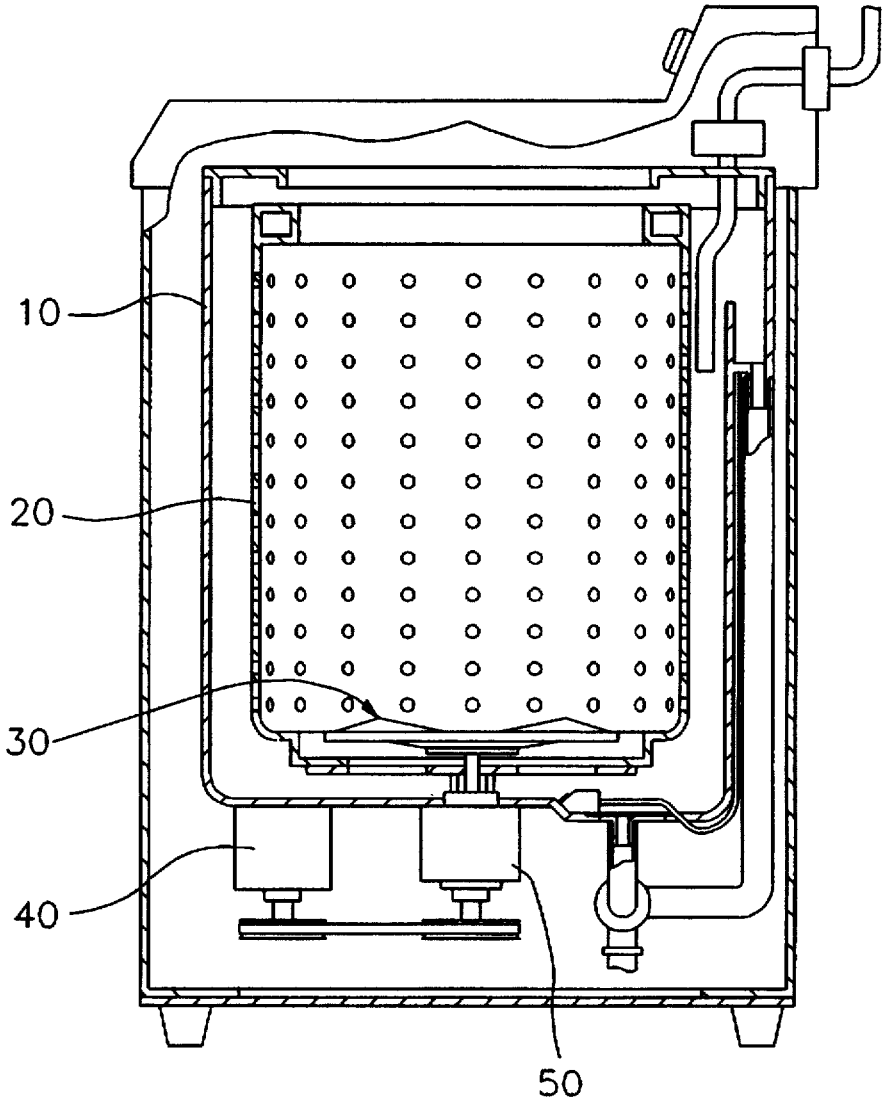
FIG. 1 PRIOR ART
FIG. 1 is a side sectional view of a conventional washing machine.
Figure 2:
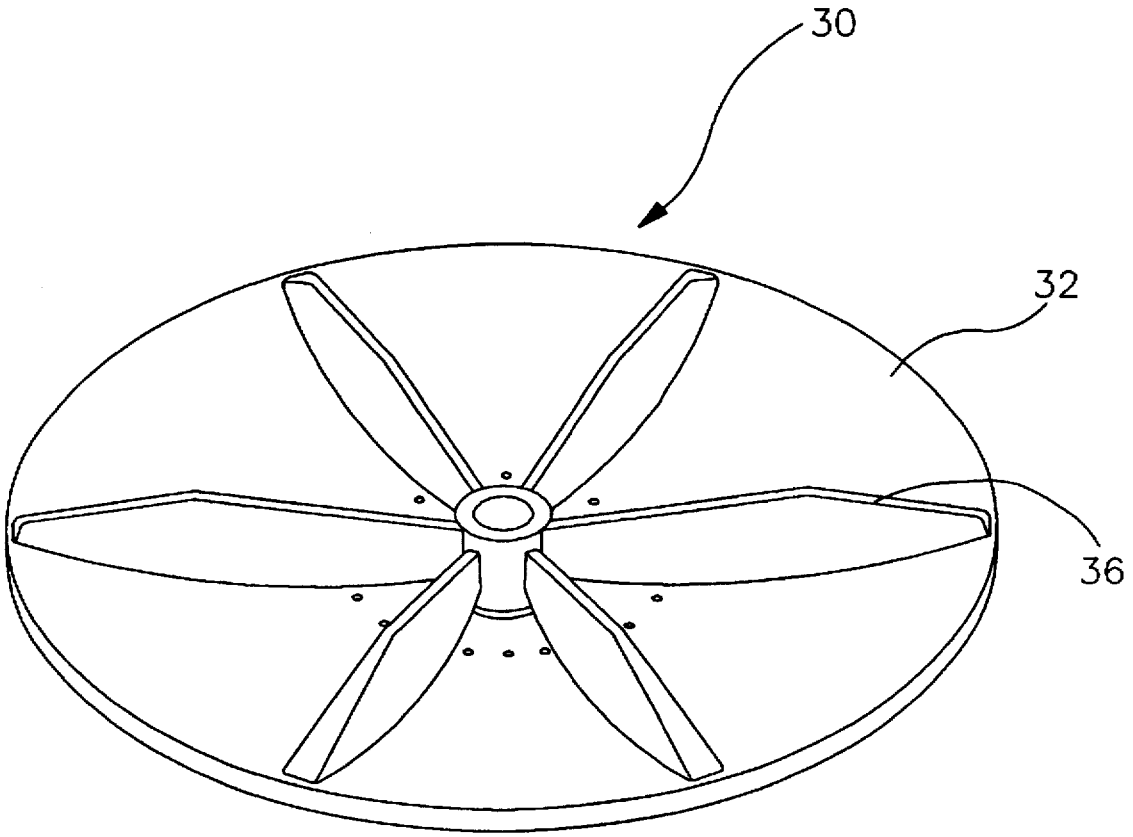
FIG. 2 PRIOR ART
FIG. 2 is a perspective view of the pulsator in FIG. 1.
Figure 4:
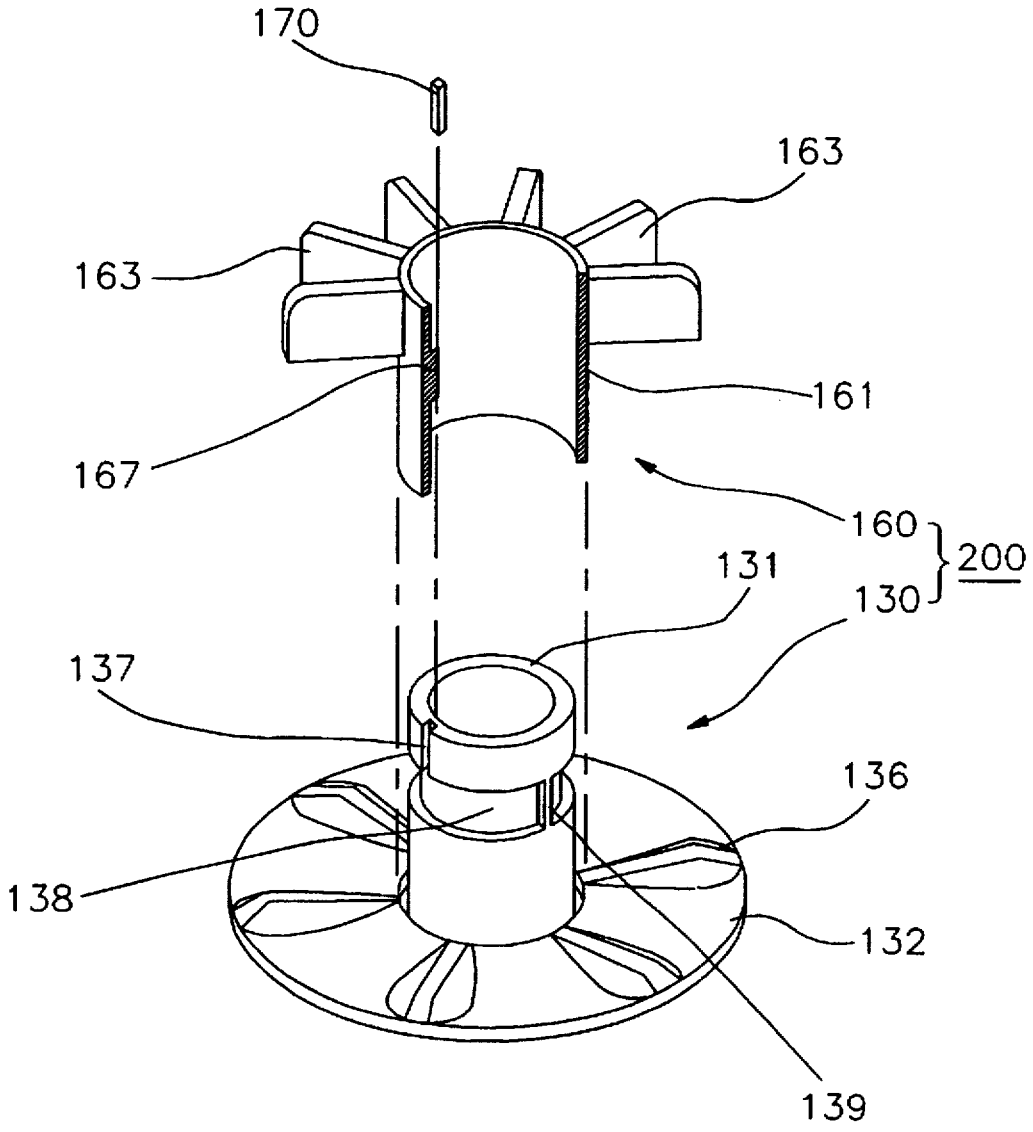
FIG. 4 is an exploded perspective view of the pulsator assembly in FIG. 3.

FIG. 4 is an exploded perspective view of the pulsator assembly in FIG. 3. The pulsator assembly 200 consists of the first pulsator 130 and the second pulsator 160. The first pulsator 130 consists of a disc-shaped body 132, a plurality of stirring wings 136 extended upwardly from the upper surface of the body 132, and a supporting bar 131 being extended to the axis direction of the body 132 at the center thereof. The stirring wings 136, as in the conventional washing machine shown in FIGS. 1 and 2, are disposed radially and symmetrically to the axis, and generate a strong water current by increasing the resistance power against the water in the washing tub 120 when the first pulsator 130 rotates. On the middle area of the supporting bar 131 along the longitudinal direction thereof, a groove 138 is formed along the rotational direction thereof, and a projection 139 is formed on a portion of the groove 138. Also, the supporting bar 131 is formed with a guide groove 137 connecting the upper end thereof and the groove 138. The second pulsator 160 is assembled by insertion with the supporting bar 131 of the first pulsator 130 so as to rotate together with or relatively to the first pulsator 130, and executes the function generating a strong water current by providing the impulse in the upper part in the washing tub 120. (Therefore, we call the second pulsator 160 an impulse pulsator hereinafter.) The impulse pulsator 160 consists of a cylinder part 161 and a plurality of wings 163 protruded on the outer surface of the cylinder part 161 to the radial direction thereof.

The cylinder part 161 is formed to have an inner diameter which is almost the same with an outer diameter of the supporting bar 131 in order to be assembled with the supporting bar 131. On a part of the inner surface of the cylinder part 161, a protrusion 167 is formed. The guide groove 137 formed on the supporting bar 131 guides the protrusion 167 into the groove 138 so that the protrusion 167 can be accommodated in the groove 138 when the cylinder part 161 is being assembled with the supporting bar 131. The wings 163 are disposed to be at equal angular distances with each other on the upper part of the outer surface of the cylinder part 161. The wings 163 are made of an elastic material, and preferably of a hard rubber like a polyurethane.

When the impulse pulsator 160 moves downwardly at the state that the protrusion 167 of the cylinder part 161 is positioned on the direct upper position of the guide groove 137 of the supporting bar 131, the protrusion 167 is guided toward the groove 138 through the guide groove 137 so as to be accommodated in the groove 138, and the first pulsator 130 and the impulse pulsator 160 become assembled. A fixing member 170 is inserted into the guide groove 137 at the assembled state of the first pulsator 130 and the impulse pulsator 160. The fixing member 170 is engaged with the guide groove 137 by form-fitting so that the segregation of the impulse pulsator 160 from the first pulsator 130 is prevented.

The first pulsator 130 and the impulse pulsator 160 can rotate relatively to each other. In that situation, the range of the relative rotation therebetween is confined by the protrusion 167 and the projection 139. That is, when the supporting bar 131 rotates in a forward or a reverse direction, (hereinafter, we mean the forward direction as the clockwise direction, and the reverse direction as the counterclockwise direction) the first pulsator 130 rotates relatively to the impulse pulsator 160 by the time the projection 139 arrives at the position of the protrusion 167, and from the time when the projection 139 arrives at the position of the protrusion 167, as the rotation continues, the impulse pulsator 160 rotates together with the first pulsator 130. Accordingly, the impulse pulsator 160 does not rotate until the first pulsator 130 rotates one turn in the forward or the reverse direction, and thereafter the impulse pulsator 160 rotates together with the first pulsator 130.

When the washing operation is in progress the torque of the motor 140 is transmitted to the first pulsator 130 through the shaft assembly 150. At that time, the first pulsator rotates in the forward or the reverse direction, and then the water current rotating in the forward and the reverse rotational direction is generated. In that situation, the torque of the first pulsator 130 is transmitted to the impulse pulsator 160 after one turn of the first pulsator 130, and the water current in the upper part and in the part around the first pulsator 130 is generated. Since the beginning of the rotation of the impulse pulsator 160 has some time gap with the beginning of the rotation of the first pulsator 130, each water current is generated at different times. Accordingly; the water current becomes more complex than that of the conventional washing machine shown in FIGS. 1 and 2 which generates the water current merely in the lower part of the washing tub or that of an agitator type washing machine which generates the water current in the lower part and the upper part simultaneously, and so the turbulent force between the water and the laundry becomes greater. When the first pulsator 130 converts the rotational direction from one direction to the other direction the water current in reverse direction is generated in the lower part in the washing tub 120, and the impulse pulsator 160 rotates to the other direction and provides the impulse toward said the other direction after one turn of the first pulsator 130. Accordingly, a more complex water current is generated. As illustrated above, whenever the rotational direction of the first pulsator 130 is reversed, the complex water current in the washing tub 120 is generated by the impulse pulsator 160, and the washing efficiency is improved. If the supporting bar 131 and the cylinder part 161 are constructed to be long so that the wings 163 are positioned at the more upper part of the washing tub 120, a stronger and more complex water current in the more upper part in the washing tub 120 can be generated.

When the washing operation ends, the torque of the motor 140 is transmitted to the washing tub 120 and the dehydration operation begins. At that time, the shaft assembly 150 rotates the washing tub 120 together with the pulsator assembly 200 at a high rotational velocity, and then the dehydration operation of the laundry is carried out.

The wings can be disposed to have a certain inclination against the axis of the supporting bar 131, and the impulse and the water current can be varied thereby. Also, in this embodiment, although the example in which only one projection is formed is shown, the projection can be formed to be a pair, and preferably these are disposed symmetrically with respect to the axis of the supporting bar 131. In this case, the angular distance of relative rotation is a distance corresponding to a half turn of the first pulsator 130. Accordingly, the time interval until the wings 163 are actuated is reduced, and another variation of the water current can be achieved.

As described above, according to the present invention, the washing efficiency is improved by the strong water current in the upper part in the washing tub 120, and specifically, as the first pulsator 130 and the impulse pulsator 160 are actuated at different point of times, a more complex water current in the washing tub 120 is generated and the washing efficiency is much improved.

Although the present invention has been described and illustrated in detail, it is clearly understood that the same is by way of illustration and example only and is not to be taken by way of limitation wherein the spirit and scope of the present invention is limited only by the terms of the appended claims.

What is claimed is:

1. A washing machine comprising:

a first pulsator installed rotatably in a washing tub, said first pulsator having a supporting bar extended to an axis direction thereof;

a second pulsator having a cylinder part assembled to said supporting bar to be capable of rotating relatively to said first pulsator, said second pulsator having at least one wing protruded to a radial direction of the axis;

a means for fixing said first pulsator with said second pulsator to be capable of relative rotation therebetween within a predetermined angular distance, said fixing means having a protrusion protruded from an inner surface of said cylinder part, said protrusion being accommodated in a groove formed along a rotational direction of said supporting bar on a middle area of an outer surface thereof, and at least one projection formed on a portion of said groove for confining further relative rotation of said supporting bar to said second pulsator when said supporting bar rotates at a certain angular distance against said second pulsator, wherein said supporting bar is formed with a guide groove connecting an end of said supporting bar with said groove and said guide groove guides said protrusion into said groove while said second pulsator is assembled with said first pulsator; and a means for driving said first pulsator in a forward and a reverse rotational direction.

2. The washing machine as claimed in claim 1, further comprising a fixing member for preventing segregation of said second pulsator from said supporting bar, said fixing member inserted into said guide groove at the assembled state of said first pulsator and said second pulsator.

* * * * *